US010362876B2

(12) United States Patent
Aono et al.

(10) Patent No.: US 10,362,876 B2
(45) Date of Patent: Jul. 30, 2019

(54) CHAIR

(71) Applicant: OKAMURA CORPORATION, Yokohama-shi, Kanagawa (JP)

(72) Inventors: Keisuke Aono, Yokohama (JP); Naho Ono, Yokohama (JP)

(73) Assignee: OKAMURA CORPORATION, Kanagawa (JP)

( * ) Notice: Subject to any disclaimer, the term of this patent is extended or adjusted under 35 U.S.C. 154(b) by 0 days.

(21) Appl. No.: 15/772,725

(22) PCT Filed: Nov. 4, 2016

(86) PCT No.: PCT/JP2016/082826

§ 371 (c)(1),
(2) Date: May 1, 2018

(87) PCT Pub. No.: WO2017/078145

PCT Pub. Date: May 11, 2017

(65) Prior Publication Data

US 2019/0200769 A1 Jul. 4, 2019

(30) Foreign Application Priority Data

Nov. 6, 2015 (JP) ..... 2015-218888
Nov. 6, 2015 (JP) ..... 2015-218924

(51) Int. Cl.
*A47C 9/00* (2006.01)
*A47C 7/14* (2006.01)
(Continued)

(52) U.S. Cl.
CPC ..... *A47C 9/002* (2013.01); *A47C 3/30* (2013.01); *A47C 7/004* (2013.01); *A47C 7/14* (2013.01)

(58) Field of Classification Search
CPC ..... A47C 9/002; A47C 9/022; A47C 9/025; A47C 3/30; A47C 3/025; A47C 3/0255;
(Continued)

(56) References Cited

U.S. PATENT DOCUMENTS 4,099,697 A 7/1978 Schuckmann
6,098,937 A * 8/2000 Carnahan ..... A47C 3/026 248/158

(Continued)

FOREIGN PATENT DOCUMENTS

DE 1 829 791 U 4/1961
DE 2642112 3/1978

(Continued)

OTHER PUBLICATIONS

International Search Report for PCT/JP2016/082826, dated Dec. 13, 2016.

(Continued)

*Primary Examiner* — Mark R Wendell
(74) *Attorney, Agent, or Firm* — Nixon Peabody LLP; Jeffrey L. Costellia

(57) ABSTRACT

A chair (1) includes an installation base (10), a leg column (11) supported by the installation base (10) in a tiltable manner, a seat body (12) supported on an upper part of the leg column (11), an elastic member (19) which urges the leg column (11) to an initial tilted posture, and a coming-off restriction member (22) which restricts coming-off of the leg column (11) from the installation base (10). On a support wall (16) of the installation base (10) having an insertion hole (20) through which part of the coming-off restriction member (22) is inserted, a slide guide (21) coming into slidable contact with a slide guide (21) at a peripheral edge portion of a lower surface side of the insertion hole (20) is provided. The coming-off restriction member (22) has an
(Continued)

upwardly protruding spherical guide surface (23) which is slidably brought into contact with the slide guide (21) below the insertion hole (20).

14 Claims, 7 Drawing Sheets

(51) Int. Cl.
*A47C 3/30* (2006.01)
*A47C 7/00* (2006.01)

(58) Field of Classification Search
CPC .. A47C 3/026; A47C 3/18; A47C 3/02; A47C 7/004; A47C 7/14; A47C 7/443; A47C 7/44; A47C 7/441; A47C 7/002; A47C 1/03255
USPC ..... 297/313, 314, 461, 258.1, 270.1, 325; 248/188.7, 188.8, 188.9, 163.1
See application file for complete search history.

(56) References Cited

U.S. PATENT DOCUMENTS

| | | | | |
|---|---|---|---|---|
| 6,644,742 | B1 * | 11/2003 | Walser | A47C 9/002 248/599 |
| 8,540,314 | B2 | 9/2013 | Fernandez | |
| 8,646,841 | B2 * | 2/2014 | Molnar | A47C 7/004 297/344.21 |
| 9,763,520 | B1 * | 9/2017 | Pan | A47C 1/03255 |
| 9,770,107 | B2 * | 9/2017 | Glockl | A47C 9/002 |
| 9,861,202 | B2 * | 1/2018 | Qi | A47C 3/0255 |
| 10,034,547 | B1 * | 7/2018 | Pan | A47C 3/0252 |
| 10,085,563 | B2 * | 10/2018 | Qi | A47C 3/0255 |
| 2011/0175414 | A1 * | 7/2011 | Asbjornsen | A47C 9/002 297/313 |
| 2015/0250317 | A1 * | 9/2015 | Glockl | A47C 9/002 297/344.12 |

FOREIGN PATENT DOCUMENTS

| | | |
|---|---|---|
| DE | 202008017086 | 4/2009 |
| DE | 202011004345 | 11/2011 |
| DE | 102010036129 | 3/2012 |
| FR | 1170615 | 1/1959 |

OTHER PUBLICATIONS

European Search Report dated Mar. 29, 2019 in European Application No. 16862204.1.

* cited by examiner

CHAIR

TECHNICAL FIELD

The present invention relates to a chair in which a seat body on which an occupant sits is supported by a leg column and the leg column is pivotably supported on an installation base.

Priority is claimed on Japanese Patent Application No. 2015-218888, filed Nov. 6, 2015, and on Japanese Patent Application No. 2015-218924, filed Nov. 6, 2015, the contents of which are incorporated herein by reference.

BACKGROUND ART

In recent years, a chair in which a leg column for supporting a seat body is tiltably supported by an installation base has been proposed (see, for example, Patent Documents 1, 2 and 3).

In the chair described in Patent Document 1, an accommodating chamber for accommodating a rubber-like elastic member is provided on the installation base, and the rubber-like elastic member is fixed to a lower end of the leg column and is accommodated in the accommodating chamber. A gap which allows swelling of the elastic member is provided in the accommodating chamber. In this chair, as the rubber-like elastic member swells outward through the gap, deformation of the elastic member itself and associated tilting of the leg column are permitted. At this time, an elastic reaction force of the elastic member acts on the leg column.

In the chair described in Patent Document 2, a flange-like abutting wall is provided at a lower end of the leg column, and a rubber-like elastic member and an auxiliary reaction force generating member such as a coil spring are interposed in parallel between the abutting wall and the installation base. In this chair, as the rubber-like elastic member and the auxiliary reaction force generating member are elastically deformed, the tilting of the leg column is permitted, and the reaction force of the elastic member and the auxiliary reaction force generating member acts on the leg column.

In the chair described in Patent Document 3, a lower end of the leg column is tiltably supported on the installation base via a rubber-like elastic member. A support wall for supporting a lower surface of the elastic member is provided on the installation base, and an abutting wall for supporting an upper surface of the elastic member is provided on the leg column. The elastic member is sandwiched in a compressed state between the abutting wall of the leg column and the support wall of the installation base. Further, a tilting allowance hole through which a lower part of the leg column is tiltably inserted is provided in the installation base, and the abutting wall and the elastic member are disposed inside the tilting allowance hole. When the leg column tilts, the abutting wall tilts together with the leg column to deform the elastic member.

Furthermore, in the chair described in Patent Document 1, the lower part of the leg column is supported by the installation base via the rubber-like elastic member, and a tilting allowance hole through which the lower part of the leg column is tiltably inserted is provided in the installation base. An abutting wall which comes into contact with an upper surface of the elastic member is provided on a leg portion, and an inward flange portion is provided on an inner peripheral edge portion of the tilting allowance hole of the installation base to cover an upper part of a peripheral edge portion of the abutting wall.

DOCUMENT OF RELATED ART

Patent Document

Patent Document 1: French Patent No. 1170615
Patent Document 2: U.S. Pat. No. 8,540,314
Patent Document 3: German Utility Model No. 202011004345

SUMMARY OF THE INVENTION

Technical Problem

The chair described in Patent Document 1 has a structure in which the rubber-like elastic member fixed to the lower end of the leg column is crushed in the accommodating chamber by tilting of the leg column, and accordingly, part of the elastic member swells outward through the gap of the accommodating chamber. Therefore, in the case of the chair described in Patent Document 1, when the leg column tilts frequently, a local load repeatedly acts on the portion of the elastic member that swells outward from the gap of the accommodating chamber. Therefore, in view of maintaining the desired performance of the components over a long period of time, improvement of the structure is desired.

In the chair described in Patent Document 2, since the rubber-like elastic member and the auxiliary reaction force generating member such as a coil spring are interposed in parallel between the abutting wall of the lower end of the leg column and the installation base, a local load due to the tilting of the leg column does not easily act on the rubber-like elastic member. However, in the case of the chair described in Patent Document 2, since the rubber-like elastic member and the auxiliary reaction force generating member having different reaction force characteristics are disposed apart from each other, it is difficult to stably obtain smooth tilting of the leg column and natural elastic reaction force.

Accordingly, an object of the present invention is to provide a chair that can obtain smooth tilting of a leg column and stable elastic reaction force by an elastic member interposed between the leg column and an installation base, while reducing a local load acting on the elastic member.

Further, in the chair described in Patent Document 3, when the leg column is in a vertical posture, the upper surface of the abutting wall of the leg column is set to be substantially the same height as the upper part of the tilting allowance hole of the installation base. Therefore, when the leg column tilts, the abutting wall is inclined with respect to an upper end portion of the tilting allowance hole, a hollow or a gap is formed inside the tilting allowance hole, and there is a possibility of causing deterioration of appearance from the outside or biting of foreign matter.

In the chair described in Patent Document 1, a flange portion that covers the upper part of the peripheral edge portion of the abutting wall is provided on the inner peripheral edge portion of the tilting allowance hole of the installation base. Therefore, although deterioration of appearance from the outside or biting of foreign matter due to tilting of the leg column is reduced, when the abutting wall, which directly receives the elastic reaction force from the elastic member, comes into contact with the flange portion, a heavy load is applied to the flange portion and the abutting wall. Therefore, it becomes difficult to stably obtain desired performance over a long period of time.

Accordingly, an object of the present invention is to provide a chair that can close a gap between a tilting allowance hole of an installation base and a leg column and can stably maintain a desired performance of components over a long period of time.

Solution to Problem

A chair according to a first aspect of the present invention includes: an installation base which is mounted on or fixed to an installation surface and includes a tilting allowance hole; a leg column which stands upward from the installation base and is supported by the installation base in a tiltable manner; a seat body which is supported on an upper part of the leg column to receive a seating load of an occupant; an elastic member which is interposed between the leg column and the installation base and urges the leg column to take a vertical posture which is an initial tilted posture; a support wall which supports the elastic member on the installation base and has an insertion hole; and a coming-off restriction portion which penetrates the support wall from below to restrict coming-off of the leg column from the installation base, in which, in the support wall of the installation base, part of the coming-off restriction portion is inserted through the insertion hole, and a slide guide coming into slidable contact with a lower surface of a peripheral edge portion of the insertion hole of the coming-off restriction portion is provided, and the coming-off restriction portion has a spherical guide surface which upwardly protrudes and comes into slidable contact with the slide guide below the insertion hole.

With the above configuration, when an external force in the tilting direction acts on the leg column, the elastic member is deformed, while the spherical guide surface of the coming-off restriction portion comes into slide-contact with the slide guide of the installation base, and the leg column tilts with respect to the installation base. At this time, since the spherical guide surface of the coming-off restriction portion comes into slide-contact with the slide guide of the installation base and is guided, the leg column tilts with the vicinity of the spherical center of the guide surface as the tilting center. Therefore, at this time, the reaction force in the expansion and contraction direction and the shear direction is accumulated in a wide region of the elastic member. Therefore, a stable reaction force by the elastic member can be obtained, and a local load does not easily occur. In addition, when the leg column tilts or returns to the initial posture, since the spherical guide surface of the coming-off restriction portion comes into slide-contact with the slide guide of the installation base and is guided, smooth tilting of the leg column and a stable elastic reaction force by the elastic member can be obtained.

In a second aspect of the chair according to the present invention, in the chair according to the first aspect, the elastic member is sandwiched and fixed in a compressed state between the leg column and the support wall of the installation base.

In this case, as an initial load in the compression direction is applied to the elastic member, excessive sinking of the leg column due to deformation of the elastic member at the time of sitting or sudden tilting of the leg column is suppressed.

In a third aspect of the chair according to the present invention, in the chair according to the first or second aspect, an abutting portion of the slide guide coming into contact with the guide surface of the coming-off restriction portion is a protruding curved surface.

In this case, the spherical guide surface stably comes into line-contact with the slide guide of the installation base regardless of the tilted position of the leg column. Therefore, unnecessary sliding resistance does not easily occur when the leg column tilts. Therefore, by adopting this structure, stable tilting of the leg column can be obtained.

In a fourth aspect of the chair according to the present invention, in the chair according to the third aspect, the abutting portion of the slide guide coming into contact with the guide surface of the coming-off restriction portion is formed in an annular shape along a circumferential region of the insertion hole.

In this case, when the leg column tilts in any direction, the spherical guide surface stably comes into line-contact with the slide guide of the installation base.

In a fifth aspect of the chair according to the present invention, in the chair according to the third aspect, the support wall and the slide guide of the installation base are formed by separate members.

In this case, for example, as the support wall is formed of a rigid member such as a metal and the slide guide is formed of a highly slidable resin or the like, it is possible to enhance the slidability of the coming-off restriction portion against the guide surface, while securing sufficient rigidity or strength of the support wall.

In a sixth aspect of the chair according to the present invention, in any one of the first to fifth aspects, the leg column has an abutting wall which protrudes outward in a radial direction from a main body portion of the leg column and comes into contact with an upper surface of the elastic member.

In this case, as the lower end of the leg column, i.e. the abutting wall having the larger outer diameter than the main body portion, comes into contact with the elastic member, it is possible to apply the load caused by the tilting of the leg column to a large area on the elastic member. Therefore, the local load does not easily act on the elastic member.

In a seventh aspect of the chair according to the present invention, in any one of the first to fifth aspects, the coming-off restriction portion is formed of a component different from a member of a main body portion of the leg column, and in a state in which the elastic member is sandwiched between the member of the main body portion and the support wall of the installation base, the coming-off restriction portion is fastened and fixed to the member of the main body portion together with the support wall, and a spacer member which restricts displacement of the coming-off restriction portion with respect to the member of the main body portion in approaching and separating directions is provided.

In this case, since the distance between the member of the main body portion of the leg column and the coming-off restriction portion is always kept constant by the spacer member, the guide surface of the coming-off restriction portion is stably guided by the slide guide, and the tilting of the leg column becomes stable.

In an eighth aspect of the chair according to the present invention, in the chair according to the first aspect, the leg column has an abutting wall which presses an upper surface of the elastic member, the tilting allowance hole of the installation base is disposed above the abutting wall of the leg column, the leg column is tiltably inserted into the tilting allowance hole, a cover member which is tiltably and integrally engaged with the leg column and closes the tilting allowance hole from below is disposed above the abutting wall, and downward displacement of the cover member is restricted by the leg column in a state in which the cover member is not fixed to the leg column.

In this case, when the leg column tilts, the cover member, the downward displacement of which is restricted by the leg column in a non-fixed state, tilts together with the leg column, and a gap between the tilting allowance hole of the installation base and the leg column is closed by the cover member, irrespective of the tilted position of the leg column. In addition, as the downward displacement of the cover member is restricted by the leg column in the non-fixed state, even when the cover member comes into contact with the installation base, large stress does not easily occur in the leg column.

In a ninth aspect of the chair according to the present invention, in the first aspect, the downward displacement of the cover member is restricted by the abutting wall in a state in which the cover member is not fixed to the abutting wall.

In this case, since the downward displacement of the cover member can be restricted using the abutting wall which presses the upper surface of the elastic member, the structure of the leg column can be simplified.

Advantageous Effects of Invention

In the present invention, the coming-off restriction portion has the upwardly protruding spherical guide surface, and when the leg column tilts, the elastic member is elastically deformed while the guide surface comes into slide-contact with the slide guide of the installation base. Accordingly, it is possible to accumulate the reaction force over a wide range of the elastic member when the leg column tilts. Therefore, according to the present invention, it is possible to reduce the load locally acting on the elastic member.

Further, in the present invention, when the leg column tilts or returns to the initial posture, since the spherical guide surface of the coming-off restriction portion comes into slide-contact with the slide guide of the installation base and is guided, it is possible to obtain smooth tilting of the leg column and a stable elastic reaction force by the elastic member.

According to the present invention, the cover member, which is engaged with the leg column in an integrally tiltable manner and closes the tilting allowance hole from below, is disposed above the abutting wall that comes into contact with the upper surface of the elastic member. Therefore, it is possible to close the gap between the tilting allowance hole of the installation base and the leg column, regardless of the tilted position of the leg column. In addition, since the downward displacement of the cover member is restricted by the leg column in a non-fixed state and excessive stress does not easily act on the cover member, it is possible to stably maintain the desired performance of the cover member over a long period of time.

DESCRIPTION OF EMBODIMENTS

Hereinafter, an embodiment of the present invention will be described with reference to the drawings.

Figure 1:
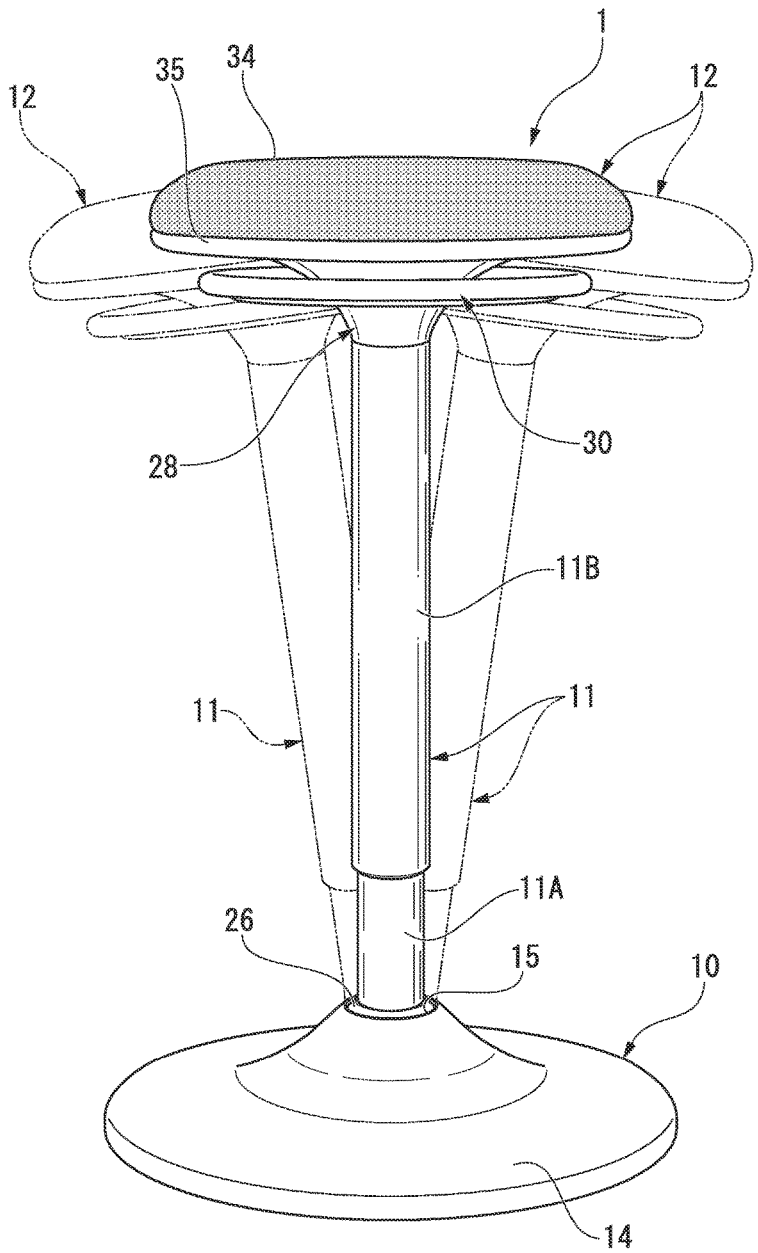
FIG. 1 is a front view of a chair according to an embodiment of the present invention.
Figure 2:
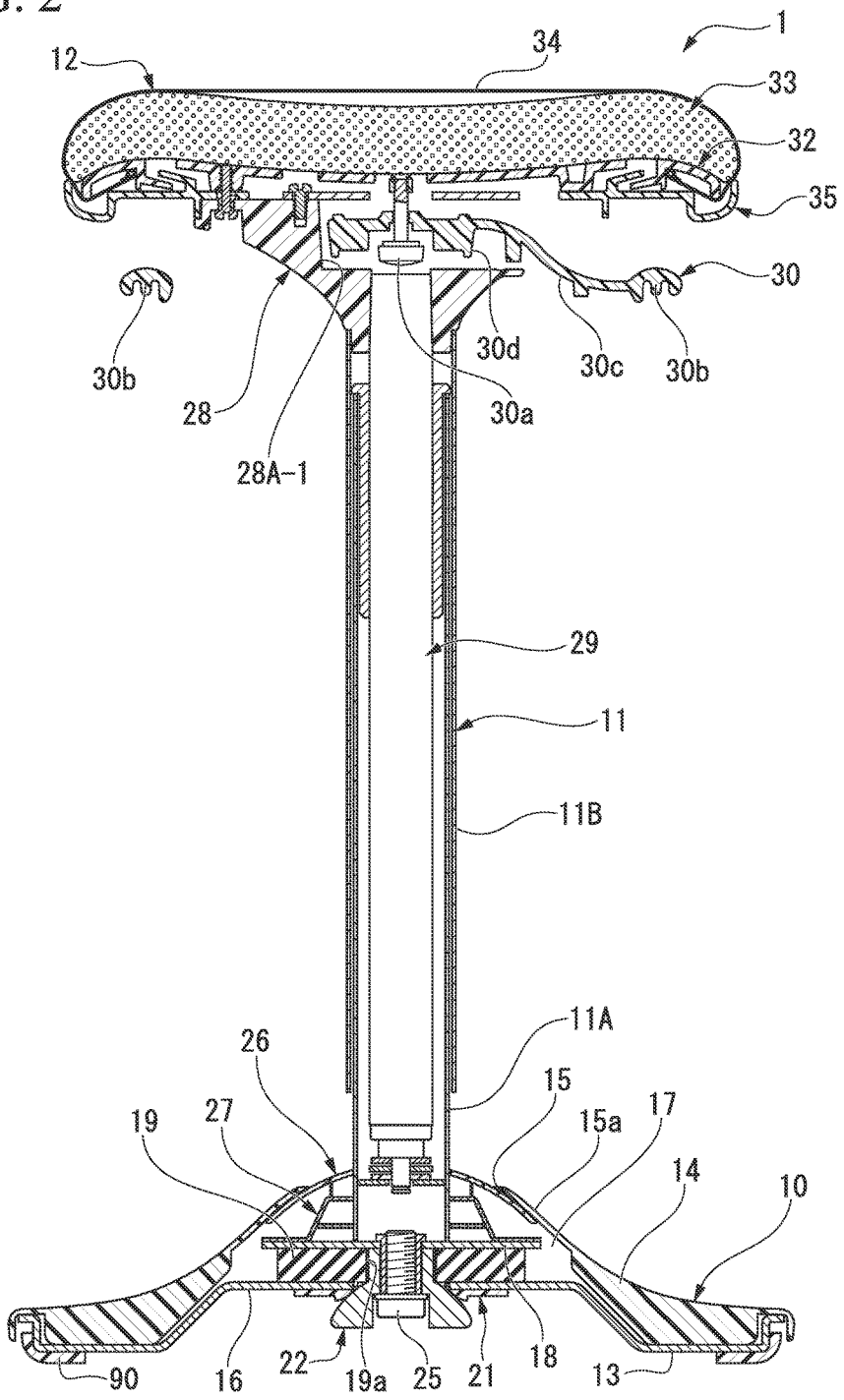
FIG. 2 is a longitudinal sectional view of the chair according to the embodiment of the present invention.

FIG. 1 is a view of a chair 1 according to the embodiment seen from the front, and FIG. 2 is a view illustrating a longitudinal section of the entire chair 1.

As illustrated in the drawings, the chair 1 includes an installation base 10 placed on an installation surface such as a floor of a building, a cylindrical leg column 11 which stands upward from the installation base 10 and is supported by the installation base 10 to be tiltable in an arbitrary direction in a circumferential direction centered on an upright position, and a seat body 12 which is supported on an upper part of the leg column 11 and has an upper surface receiving a seating load of an occupant.

Figure 3:
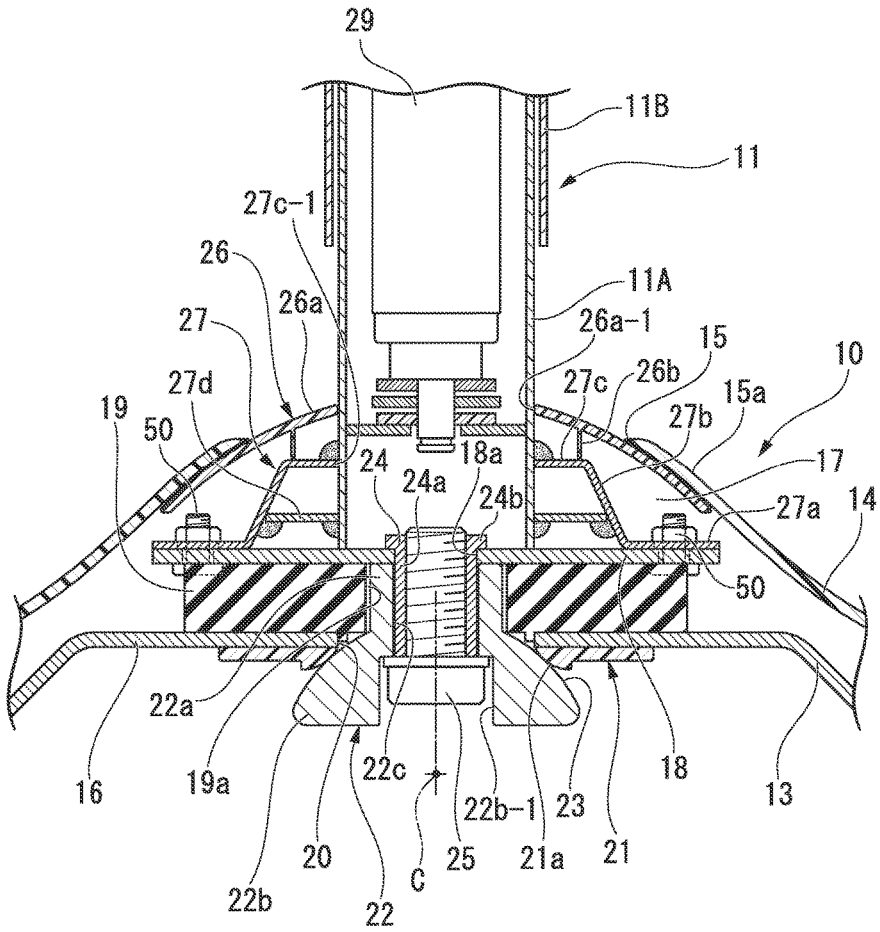
FIG. 3 is a longitudinal sectional view of a lower region of the chair according to the embodiment of the present invention.

FIG. 3 is an enlarged view of a longitudinal section of a lower region of the chair 1 centered on the installation base 10.

The installation base 10 includes a base frame 13 which is made of sheet metal having a circular shape when viewed in a top view, and an upper member 14 which is made of a resin having a circular shape when viewed in a top view, is attached to the base frame 13, and covers an upper part of the base frame 13. The upper member 14 swells upward, while drawing a gentle curved surface from an outer peripheral edge portion toward a central portion. In a center region of the swelling portion, a tilting allowance hole 15 through which a lower region of the leg column 11 is tiltably inserted is formed. A center region of the base frame 13 is raised upward, and the raised portion is a flat wall extending substantially horizontally. The flat wall serves as a support wall 16 which supports a lower surface of an elastic member 19 which will be described later. A space portion 17 is provided between an upper surface of the support wall 16 of the base frame 13 and the upper member 14.

A peripheral edge portion 15*a* of the tilting allowance hole 15 of the upper member 14 is formed by a thin wall having a substantially constant thickness, and a lower surface of the peripheral edge portion 15*a* is formed as a substantially spherical arcuate surface to substantially follow the shape of an upper surface of the peripheral edge portion 15*a*. As illustrated in FIG. 2, an annular installing member 90 protruding downward and coming into contact with the installation surface is attached to a lower surface of an outer peripheral edge portion of the base frame 13. The installing member 90 is formed of a resin material that does not easily slip and is disposed inside of an outer peripheral end portion of the installation base 10.

A flat abutting wall 18 made of sheet metal having a circular shape when viewed in a plan view is integrally provided at a lower end portion of the leg column 11. Specifically, the abutting wall 18 is integrally attached to a lower end of a main body portion (an inner cylinder 11A) of the leg column 11 by welding or the like. A disk-shaped rubber-like elastic member 19 having a through-hole 19*a* at the center is interposed between the upper surface of the support wall 16 of the base frame 13 and a lower surface of the abutting wall 18 of the leg column 11. The elastic member 19 is sandwiched between the abutting wall 18 and the support wall 16 in a state in which elastic member 19 is compressed by the abutting wall 18 and the support wall 16 (a state in which the initial reaction force is accumulated). Therefore, the lower end of the leg column 11 is tiltably supported by the installation base 10 via the elastic member 19. The elastic member 19 urges the leg column 11 by the elastic reaction force so that the leg column 11 takes a vertical posture which is an initial tilted posture.

An insertion hole 20 having an inner diameter larger than that of the through-hole 19*a* of the elastic member 19 is formed at a central portion of the support wall 16 of the base frame 13. An annular slide guide 21 made of a highly slidable resin member is attached to a lower surface of a peripheral edge portion of the insertion hole 20 of the support wall 16.

On an inner peripheral edge portion of the slide guide 21, a support surface 21*a* having a circular arcuate cross section which protrudes downward is formed. The circular arcuate cross section of the support surface 21*a* is formed continuously along the circumferential direction of the slide guide 21.

A coming-off restriction member 22 (coming-off restriction portion) is installed so as to penetrate the slide guide 21, the insertion hole 20 of the support wall 16, and the through-hole 19*a* of the elastic member 19 from the lower surface side of the support wall 16 and abuts against the lower surface of the abutting wall 18.

The coming-off restriction member 22 has a shaft portion 22*a* inserted through the through-hole 19*a* of the elastic member 19, and a hemispherical head portion 22*b* connected to a lower end of the shaft portion 22*a* and protruding outward in the radial direction. An upper part of the head portion 22*b* has a spherical outer surface, and the spherical portion is a guide surface 23 that comes into slidable contact with the support surface 21*a* of the slide guide 21.

In a state in which the guide surface 23 of the head portion 22*b* is brought into contact with the slide guide 21, the coming-off restriction member 22 is fixed to the abutting wall 18 of the leg column 11 by a cylindrical spacer member 24 made of a metal and a bolt 25.

The spacer member 24 has a shaft portion 24*a* and a flange portion 24*b* at an upper end of the shaft portion 24*a*. A through-hole 18*a* is formed in the abutting wall 18 of the leg column 11, and the shaft portion 24*a* of the spacer member 24 is inserted into the through-hole 18*a* from above. The flange portion 24*b* of the spacer member 24 comes into contact with an upper surface of the abutting wall 18 to restrict the downward displacement of the spacer member 24. Further, on an inner peripheral surface of the shaft portion 24*a* of the spacer member 24, a female screw into which a shaft portion of the bolt 25 is screwed is provided.

A shaft hole 22*c* is provided in the coming-off restriction member 22, and the shaft portion 24*a* of the spacer member 24 is inserted into the shaft hole 22*c*. A recess 22*b*-1 communicating with the shaft hole 22*c* is formed on an end surface (a lower surface in FIG. 3) of the head portion 22*b* of the coming-off restriction member 22. The bolt 25 is screwed into the female screw of the spacer member 24 in the shaft hole 22*c* from the recess 22*b*-1 of the coming-off restriction member 22 side. When the bolt 25 is tightened in the spacer member 24, the tightening load of the bolt 25 acts on the support wall 16 of the installation base 10 via the head portion 22*b* of the coming-off restriction member 22. As a result, the elastic member 19 interposed between the abutting wall 18 and the support wall 16 is compressed. When the coming-off restriction member 22 is pressed to the direction of the abutting wall 18 (the inner cylinder 11A of the leg column 11) by a predetermined amount or more due to the tightening of the bolt 25, a head portion of the bolt 25 comes into contact with the shaft portion 24*a* of the spacer member 24, and the tightening of the bolt 25 (displacement of the coming-off restriction member 22 with respect to the inner cylinder 11A in the approaching direction) is restricted.

When the coming-off restriction member 22 is fixed to the abutting wall 18 by the bolt 25 as described above, the elastic member 19 is compressed by a predetermined amount by the abutting wall 18 and the support wall 16. In this state, as the head portion 22*b* of the coming-off restriction member 22 comes into contact with the slide guide 21, coming-off of the leg column 11 from the installation base 10 is restricted.

As the elastic member 19 sandwiched between the flat abutting wall 18 and the support wall 16 is bent, the leg column 11 is permitted to tilt in an arbitrary direction. When the leg column 11 tilts, the spherical guide surface 23 of the head portion 22*b* of the coming-off restriction member 22 slides on the support surface 21*a* of the slide guide 21, and the tilting of the leg column 11 is guided. Therefore, the leg column 11 tilts about the vicinity of the center C of the spherical guide surface 23 below the elastic member 19.

In this embodiment, since the coming-off restriction member 22 is fixed to the abutting wall 18 by the spacer member 24 and the bolt 25, the elastic member 19 is compressed by a predetermined amount, but the elastic member 19 may be compressed in advance before fixing the coming-off restriction member 22 to the abutting wall 18.

A support member 27 made of metal having a truncated conical shape is attached to the upper surface of the abutting wall 18. A cover member 26 that closes a gap between the tilting allowance hole 15 and the leg column 11 from below is disposed in the vicinity of the tilting allowance hole 15 of the upper member 14. The cover member 26 is formed integrally of a resin, and has a thin-walled cover main body portion 26*a* formed by a substantially spherical three-dimensional curved surface.

A through-hole 26*a*-1 through which the inner cylinder 11A of the leg column 11 is inserted is formed at a central portion of the cover main body portion 26*a*. On a lower surface of an outer peripheral edge portion of the through-hole 26*a*-1 of the cover main body portion 26*a*, a protruding portion 26*b* protruding downward in a cylindrical shape is provided. As a lower end of the protruding portion 26*b* comes into contact with the support member 27 in a freely slidable manner, the excessive downward displacement of the cover member 26 is restricted by the support member 27. When the leg column 11 tilts, as a peripheral wall of the through-hole 26*a*-1 comes into contact with the outer peripheral surface of the leg column 11 (the inner cylinder 11A), the cover member 26 tilts and is displaced following the tilting of the leg column 11.

As described above, the support member 27 attached to the abutting wall 18 is formed of a metallic material in a truncated conical shape. Specifically, the support member 27 includes an outward flange 27*a*, a tapered cylindrical portion 27*b* which gradually decreases in diameter from an inner end portion of the outward flange 27*a* towards an upward direction, and an upper wall portion 27*c* that bends inward in the radial direction from an upper end of the cylindrical portion 27*b* and extends substantially horizontally. A through-hole 27*c*-1 is formed at a central portion of the upper wall portion 27*c*. The inner cylinder 11A of the leg column 11 is fitted into the through-hole 27*c*-1, and a peripheral edge portion of the through-hole 27*c*-1 is fixed to the outer surface of the inner cylinder 11A by welding. The outward flange 27*a* is placed on the upper surface of the abutting wall 18 and fixed to the abutting wall 18 by a fastening member 50 such as a bolt and a nut.

An annular reinforcing plate 27*d* extending substantially horizontally is fixed to an inner peripheral surface of the cylindrical portion 27*b* by welding. The inner cylinder 11A of the leg column 11 is fitted into an inner peripheral portion of the reinforcing plate 27*d*, and the inner peripheral portion of the reinforcing plate 27*d* is fixed to the outer peripheral surface of the inner cylinder 11A by welding.

Further, in this embodiment, the outward flange 27*a* of the support member 27 constitutes a lower wall portion that comes into contact with the upper surface of the abutting wall 18, and the cylindrical portion 27*b* and the upper wall portion 27*c* constitute a standing wall portion that stands upward from the lower wall portion and comes into contact with the leg column 11.

The leg column 11 includes an outer cylinder 11B having an upper end to which a seat support member 28 is attached, the inner cylinder 11A assembled to the outer cylinder 11B in a freely advancing and retracting manner, and a gas spring 29 disposed to straddle the seat support member 28 and the inner cylinder 11A to adjust the length of extension and contraction of the inner cylinder 11A and the outer cylinder 11B. When an expansion and contraction adjustment portion (not illustrated) provided at an upper end portion of the gas spring 29 is pressed by an operating lever 30 to be described later, the gas spring 29 can freely adjust the length of expansion and contraction (lifted height of the seat body 12) between the inner cylinder 11A and the outer cylinder 11B.

Figure 4:
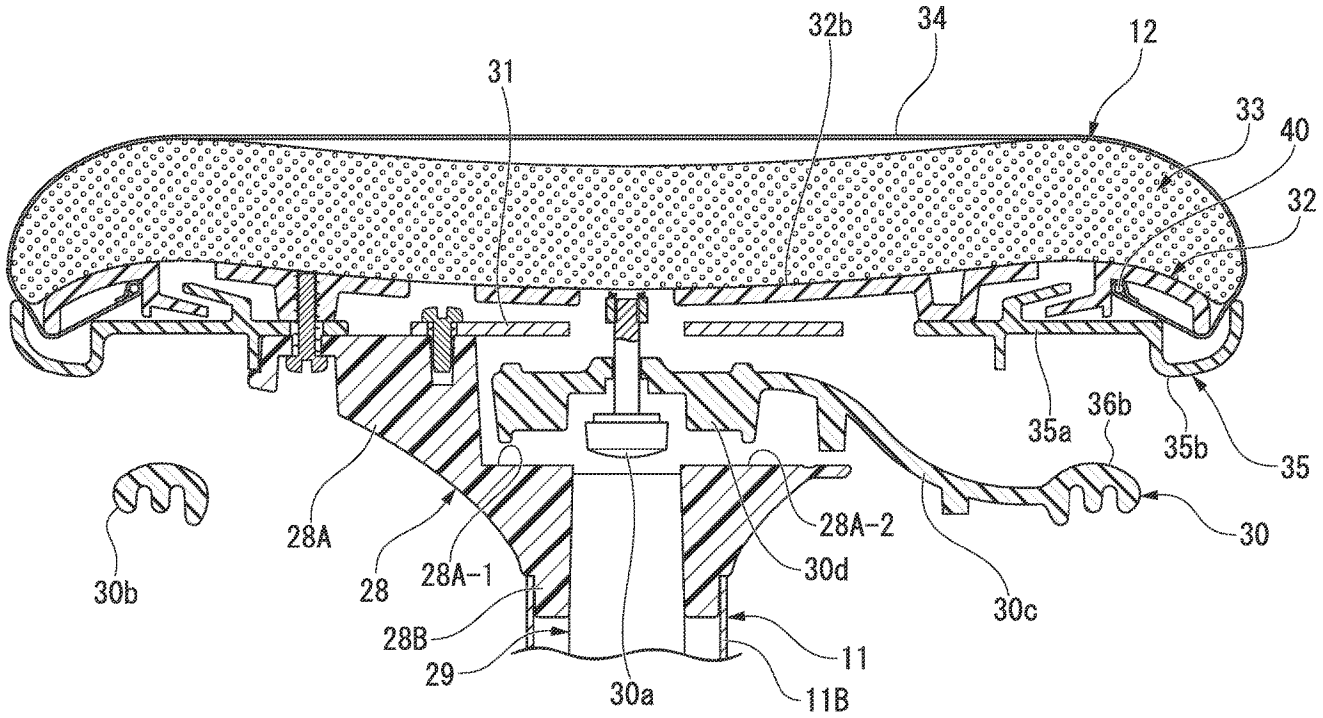
FIG. 4 is a longitudinal sectional view of an upper region of the chair according to the embodiment of the present invention.
Figure 5:
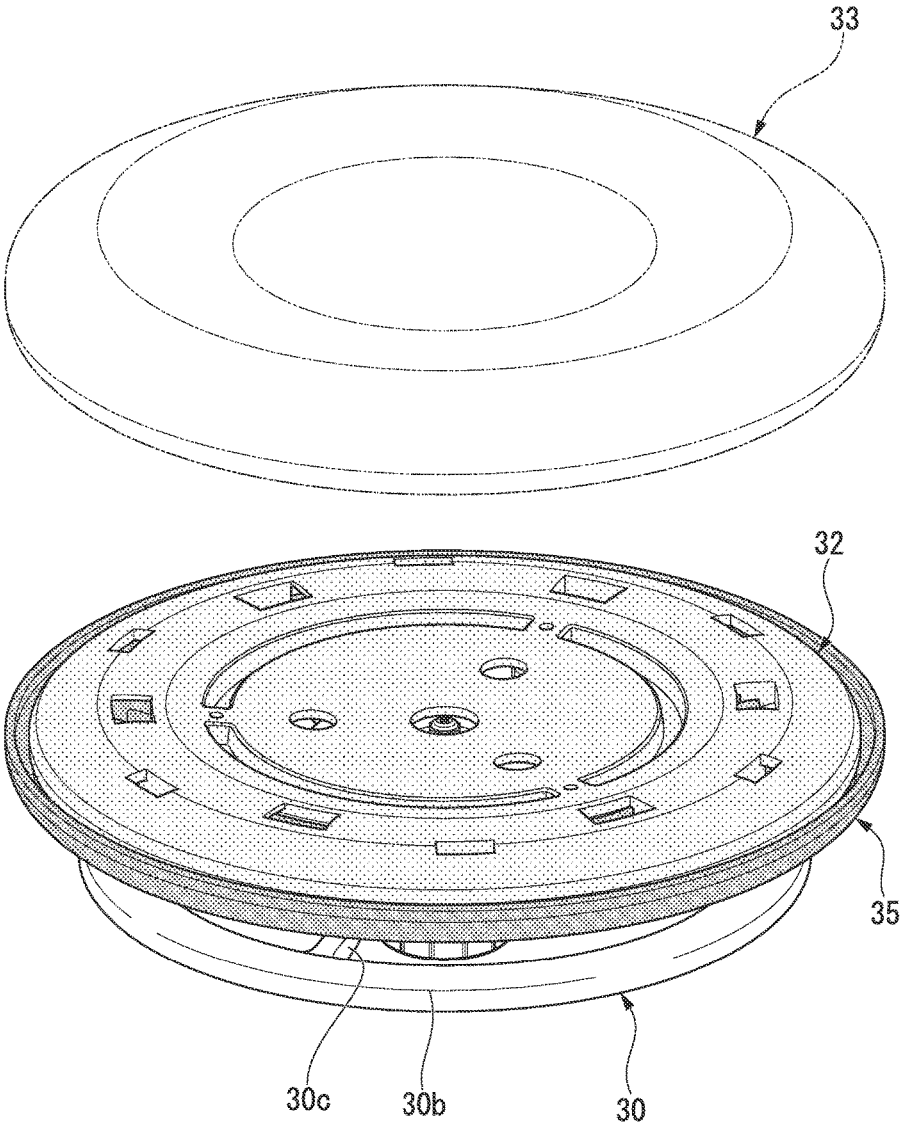
FIG. 5 is a perspective view of a part of a seat body of the chair according to the embodiment of the present invention.

FIG. 4 is an enlarged view illustrating a longitudinal section of an upper region of the chair 1 around the seat body 12, and FIG. 5 is an exploded view of part of the seat body 12.

The seat support member 28 includes a main body block 28A having an upper end surface to which the seat body 12 is attached, and a boss portion 28B integrally provided at a lower end of the main body block 28A and fitted and fixed to an upper end portion of the outer cylinder 11B. An upper end portion of the gas spring 29 is fitted and fixed to the boss portion 28B and the axial center portion of the main body block 28A. A recess 28A-1 in which a push operating portion 30*a* at a base end of the operating lever 30 is disposed is formed substantially at the center of an upper surface of the main body block 28A.

The operating lever 30 includes an annular ring operating portion 30*b*, a plurality of connecting arm portions 30*c* extending radially inward from the ring operating portion 30*b*, and a boss portion 30*d* connected to radially inner end portions of the plurality of connecting arm portions 30*c*, and the push operating portion 30*a* is held in the boss portion 30*d*. The ring operating portion 30*b* of the operating lever 30 is arranged on the radially outer side of the main body block 28A of the seat support member 28 so as to be coaxially with the main body block 28A. A plurality of insertion grooves 28A-2 through which the respective connecting arm portions 30*c* of the operating lever 30 are inserted are formed in the main body block 28A of the seat support member 28. A closing plate 31 made of metal is attached to the upper surface of the main body block 28A. The upward displacement of the boss portion 30*d* and the connecting arm portions 30*c* of the operating lever 30 is restricted by the closing plate 31.

When any portion of the ring operating portion 30*b* of the operating lever 30 in the circumferential direction is lifted upward, the push operating portion 30*a* in the main body block 28A is inclined together with the boss portion 30*d*, and at that time, the push operating portion 30*a* presses the expansion and contraction adjustment portion of the gas spring 29. Therefore, in the case of the operating lever 30, when the ring operating portion 30*b* is lifted up from any direction in the circumferential direction, the gas spring 29 can be similarly expanded and contracted.

The seat body 12 includes a seat plate 32 made of a hard resin and fixed to the upper surface of the main body block 28A of the seat support member 28, a cushion material 33 that is an interior material supported on an upper surface of the seat plate 32, a skin material 34 which covers an upper surface and an outer side of an outer edge portion of the cushion material 33 and is fixed to the seat plate 32 by being narrowed inward at an outer peripheral edge portion on a lower surface side of the seat plate 32, and a seat plate cover 35 which is made of a resin, is attached to the lower surface of the outer peripheral edge portion of the seat plate 32 and covers the lower surface and the outer peripheral edge portion of the seat plate 32. In FIG. 4, reference numeral 40 is a cord material for tightening an outer peripheral edge portion of the skin material 34 which covers the cushion material 33 on the lower surface side of the seat plate 32.

In the chair 1 according to this embodiment, an occupant can sit on the seat body 12 as follows.

The occupant stands facing away, for example, in front of the seat body 12 of the chair 1, and lowers his or her hips onto the upper surface of the seat body 12 with his or her hands placed on the seat body 12. At this time, the leg column 11 of the chair 1 appropriately tilts with respect to the installation base 10 in accordance with the position and direction of the load applied to the seat body 12 by the occupant. At this time, the elastic member 19 interposed between the installation base 10 and the leg column 11 is deformed, and a reaction force corresponding to tilting of the leg column 11 is generated in the elastic member 19.

The chair 1 stops tilting of the leg column 11 when the reaction force accumulated in the elastic member 19 and the load which is input to the seat body 12 through the buttocks of the occupant are balanced. In this state, the buttocks of the occupant are stably held on the upper surface of the seat body 12.

Figure 6:
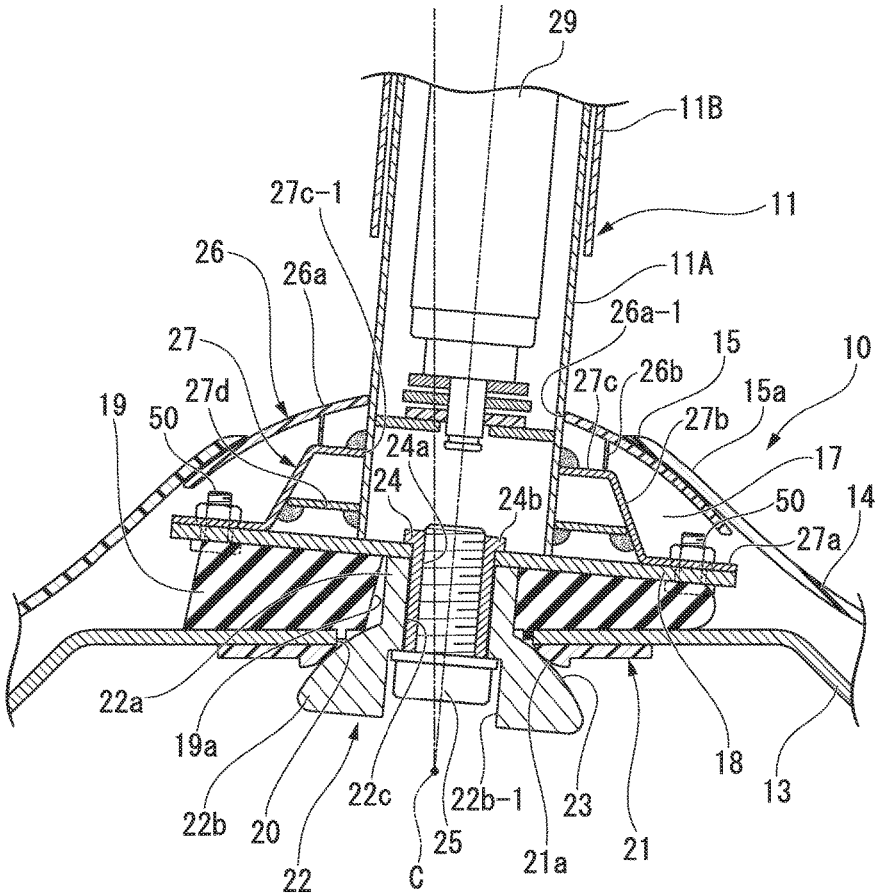
FIG. 6 is a longitudinal sectional view of the lower region of the chair according to the embodiment of the present invention.

FIG. 6 is a view illustrating behaviors when the leg column 11 tilts with respect to the installation base 10.

When a load is applied to the seat body 12 or the like and the leg column 11 tilts, as illustrated in FIG. 6, while the elastic member 19 interposed between the abutting wall 18 and the support wall 16 is crushed to the side to which the load is applied, the spherical guide surface 23 of the coming-off restriction member 22 located below the elastic member 19 slides with respect to the support surface 21*a* of the slide guide 21, and the tilting of the leg column 11 is guided by this sliding.

Therefore, when the leg column 11 tilts, since the leg column 11 tilts around the vicinity of the center C of the spherical guide surface 23, the moment of the force directed toward the vicinity of the center C of the spherical guide surface 23 acts on the upper part of the elastic member 19 sandwiched between the abutting wall 18 and the support wall 16, from the entire lower surface of the abutting wall 18 which is in contact with the elastic member 19. Therefore, the load in the compression direction and the shear direction is accumulated as elastic reaction force in a wide region of the elastic member 19. As a result, a local load does not easily act on the elastic member 19.

In this way, in the chair 1 according to this embodiment, the coming-off restriction member 22 provided at the lower end of the leg column 11 has the spherical guide surface 23 protruding upward, and when the leg column 11 tilts, while the guide surface 23 of the member 22 comes into slide-contact with the slide guide 21 of the installation base 10, the elastic member 19 is elastically deformed. Therefore, when the leg column 11 tilts, it is possible to suppress the local load from acting on the elastic member 19, and it is possible to obtain a smooth tilting motion of the leg column 11 and a stable elastic reaction force by the elastic member 19.

In particular, in the chair 1 according to this embodiment, the guide surface 23 of the coming-off restriction member 22 is formed in a spherical shape protruding upward, and the leg column 11 tilts around the vicinity of the center C of the guide surface 23 disposed below the elastic member 19. Therefore, when the leg column 11 tilts, a load as a moment of a force directed toward the vicinity of the center C of the guide surface 23 is input to the upper part of the elastic member 19, from the entire lower surface of the abutting wall 18 which is in contact with the elastic member 19. Accordingly, it is possible to accumulate the elastic reaction force in a wide region of the elastic member 19. Therefore, the chair 1 according to this embodiment can enhance durability of the elastic member 19, and a sufficient tilting reaction force can be obtained without causing an increase in the wall thickness of the elastic member 19.

Further, in the chair 1 according to this embodiment, since the elastic member 19 is sandwiched and fixed in a compressed state between the abutting wall 18 of the leg column 11 and the support wall 16 of the installation base 10, it is possible to suppress excessive sinking of the leg column 11 due to the deformation of the elastic member 19 or sudden tilting of the leg column 11 at the time of seating.

Further, in the chair 1 according to this embodiment, since the support surface 21*a* of the slide guide 21 which guides the guide surface 23 of the coming-off restriction member 22 is formed by the convex curved surface, the spherical guide surface 23 of the coming-off restriction member 22 can be supported in a line contact state by the support surface 21*a* of the slide guide 21, irrespective of the tilted position of the leg column 11. Therefore, by adopting this structure, unnecessary sliding resistance at the slide guide 21 can be reduced, and the stable tilting of the leg column 11 can be obtained.

In particular, in the case of this embodiment, since the support surface 21*a* of the slide guide 21 is formed in an annular shape along the circumferential region of the insertion hole 20 of the support wall 16, even when the leg column 11 tilts in any direction, the spherical guide surface 23 can be supported in a line contact state by the slide guide 21.

In the chair 1 according to this embodiment, the support wall 16 of the installation base 10 and the slide guide 21 are formed of separate components. The support wall 16 is formed of a rigid metal material, and the slide guide 21 is formed of a highly slidable resin. Therefore, the slidability of the coming-off restriction member 22 with respect to the guide surface 23 can be easily enhanced while securing sufficient rigidity or strength of the support wall 16.

In the chair 1 according to this embodiment, the abutting wall 18 is provided at the lower end of the main body portion (the inner cylinder 11A) of the leg column 11 to protrude outward in the radial direction from the main body portion of the leg column 11. Therefore, the load caused by the tilting of the leg column 11 can be applied to the upper surface of the elastic member 19 with a large area of the abutting wall 18. Therefore, it is possible to disperse the load caused by the tilting of the leg column 11 in a wider region of the elastic member 19, and to further reduce the local load acting on the elastic member 19.

Further, in the chair 1 according to this embodiment, the coming-off restriction member 22 is formed of a component separate from a member (the abutting wall 18) of the main body portion of the leg column 11, and in a state in which the elastic member 19 is sandwiched between the abutting wall 18 and the support wall 16, the coming-off restriction member 22 is fastened and fixed together with them, and the spacer member 24 for restricting displacement of the coming-off restriction member 22 with respect to the abutting wall 18 in the approaching and separating directions is provided. Therefore, since the distance between the abutting wall 18 and the coming-off restriction member 22 is always maintained constant by the spacer member 24, when the guide surface 23 is guided by the slide guide 21 and the leg column 11 tilts, the tilting of the leg column 11 can be stabilized.

Figure 7:
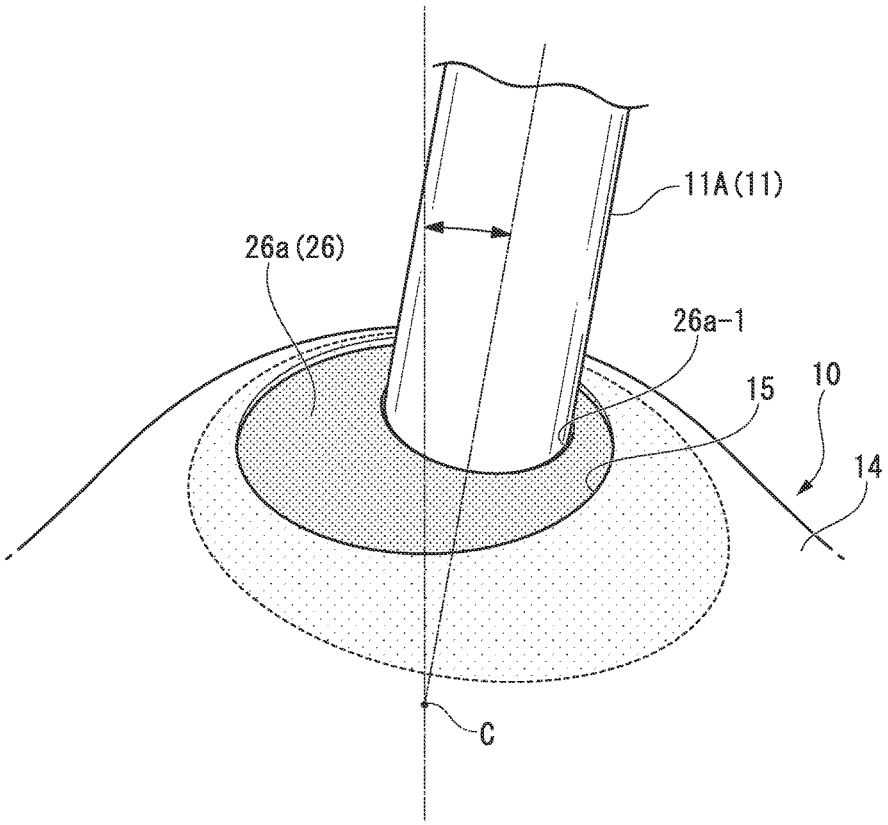
FIG. 7 is a perspective view of the lower region of the chair according to the embodiment of the present invention.

Next, the behavior of the cover member 26 when the leg column 11 tilts with respect to the installation base 10 will be mainly discussed with reference to FIGS. 6 and 7.

When a load is applied to the seat body 12 or the like to tilt the leg column 11, as illustrated in FIG. 6, while the elastic member 19 interposed between the abutting wall 18 and the support wall 16 is crushed to the side to which the load is applied, the spherical guide surface 23 of the coming-off restriction member 22 positioned below the elastic member 19 slides with respect to the slide guide 21, and the tilting of the leg column 11 is guided by this sliding. Accordingly, at this time, the leg column 11 tilts in the direction to which the load is applied, around the center C of the spherical guide surface 23.

Further, when the leg column 11 tilts around the vicinity of the center C of the spherical guide surface 23 in this manner, the inner cylinder 11A of the leg column 11 is displaced inside the tilting allowance hole 15 of the installation base 10. At this time, the outer peripheral surface of the inner cylinder 11A comes into contact with the peripheral wall of the through-hole 26*a*-1 of the cover member 26, and the cover member 26 tilts and is displaced following the displacement of the inner cylinder 11A. Therefore, as illustrated in FIG. 7, the gap between the tilting allowance hole 15 of the installation base 10 and the inner cylinder 11A is maintained in a closed state from below by the cover member 26.

When the cover member 26 tilts and is displaced following the displacement of the inner cylinder 11A in this manner, as illustrated in FIG. 6, an outer peripheral edge portion of the cover main body portion 26*a* of the cover member 26 approaches or comes into slide-contact with the lower surface of the peripheral edge portion 15*a* of the tilting allowance hole 15 and is displaced. At this time, even if the inner cylinder 11A suddenly tilts and the cover main body portion 26*a* is pressed against the peripheral edge portion 15*a* of the tilting allowance hole 15, the downward displacement of the cover member 26 is restricted by the support member 27 at the protruding portion 26*b* of the lower surface of the cover member 26. Therefore, a contact impact received from the installation base 10 is parried by sliding or slight floating of the protruding portion 26*b* on the support member 27.

As described above, in the chair 1 according to this embodiment, the cover member 26 which closes the gap between the tilting allowance hole 15 and the leg column 11 is disposed above the abutting wall 18 which comes into contact with the elastic member 19 and is attached to the lower end of the leg column 11A. The cover member 26 is integrally tiltably engaged with the leg column 11, and downward displacement of the cover member 26 is restricted by the abutting wall 18 in a state in which the cover member 26 is not fixed to the abutting wall 18. Therefore, in the chair 1 according to this embodiment, it is possible to close the gap between the tilting allowance hole 15 and the leg column 11, regardless of the tilted position (tilted angle or direction) of the leg column 11. Moreover, it is possible to prevent excessive stress from acting on the cover member 26 when the leg column 11 tilts. Therefore, in the case of this chair 1, the desired performance of the cover member 26 can be stably maintained over a long period of time.

In this embodiment, the downward displacement of the cover member 26 is restricted by the abutting wall 18 that comes into contact with the elastic member 19. However, a displacement restriction portion such as a support flange may be additionally provided on the leg column 11, and the downward displacement of the cover member 26 may be restricted by the displacement restriction portion. However, when the downward displacement of the cover member 26 is restricted by the abutting wall 18 as in this embodiment, the manufacturing cost can be reduced by simplifying the structure of the leg column 11.

Further, in the chair 1 according to this embodiment, the cover main body portion 26*a* of the cover member 26 is formed in a substantially spherical shape around the vicinity of the tilting center of the leg column 11. Therefore, when the leg column 11 tilts in any direction, it is easier to keep the distance or the contact pressure between the peripheral edge portion 15*a* of the tilting allowance hole 15 and the outer surface of the cover main body portion 26*a* constant.

In the case of this embodiment, since the abutting wall 18 that comes into contact with the elastic member 19 is formed to protrude outward in the radial direction from the inner cylinder 11A of the leg column 11, the load accompanying the tilting of the leg column 11 can be applied to a large area on the elastic member 19. Therefore, by adopting this structure, the reaction force by the elastic member 19 can be efficiently enhanced.

Furthermore, in the chair 1 according to this embodiment, the support member 27 that comes into contact with the cover member 26 from below is installed on the abutting wall 18. Therefore, the cover member 26 can be stably supported from below by the support member 27 which stands upward, while keeping the abutting wall 18 in a flat shape that easily transmits the load to the elastic member 19. Therefore, by adopting this structure, it is possible to achieve both the stable load transmission from the abutting wall 18 to the elastic member 19 and the prevention of downward displacement of the cover member 26 at the same time.

The chair 1 according to this embodiment has the outward flange 27*a* which is a lower wall portion that comes into contact with the upper surface of the abutting wall 18, and the cylindrical portion 27*b* and the upper wall portion 27*c* that are standing wall portions standing upward from the outward flange 27*a*. Therefore, in a state in which the outward flange 27*a* as the lower wall portion is brought into contact with the abutting wall 18 and the cylindrical portion 27*b* and the upper wall portion 27*c* as the standing wall portions are brought into contact with the leg column, the cover member 26 can be stably supported from below by the support member 27 in a non-contact state.

In particular, in this embodiment, the standing wall portion of the support member 27 is configured to have the cylindrical portion 27*b* extending upward from the outward flange 27*a*, and the upper wall portion 27*c* which bends from the upper part of the cylindrical portion 27*b*, extends substantially horizontally, and has the inner peripheral edge portion that comes into contact with the inner cylinder 11A. Therefore, the support member 27 has a crank-shaped cross-sectional shape with high rigidity, and it is possible to efficiently receive the load of the support member 27 in the falling direction. Therefore, by adopting this structure, it is possible to stably maintain the shape of the support member 27 and to stably support the cover member 26 from below all the time.

Further, in the case of this embodiment, since the protruding portion 26*b* which is slidably brought into contact with the support member 27 is provided at the lower surface of the cover member 26, the lower surface side of the cover member 26 can be stably supported on the support member 27 by the protruding portion 26*b*, while suppressing the height of the support member 27 from becoming higher than necessary.

It should be noted that the present invention is not limited to the above embodiment, and various design changes can be made without departing from the gist thereof. For example, in the above-described embodiment, the installation base 10 is movably mounted on the installation surface such as a floor of a building, but the installation base 10 may be fixedly installed on the installation surface.

INDUSTRIAL APPLICABILITY

According to the chair of the present invention, it is possible to accumulate a reaction force over a wide range of the elastic member when the leg column tilts, and it is possible to reduce the load acting locally on the elastic member. Further, it is possible to obtain a smooth tilting of the leg column and a stable elastic reaction force by the elastic member.

Furthermore, it is possible to close the gap between the tilting allowance hole of the installation base and the leg column, regardless of the tilted position of the leg column. In addition, since the downward displacement of the cover member is restricted in a state where the cover member is not fixed to the leg column and an excessive stress does not easily act on the cover member, it is possible to maintain the desired performance of the cover member stably over a long period of time.

DESCRIPTION OF REFERENCE SIGNS

1 Chair
10 Installation base
11 Leg column
11A Inner cylinder (main body portion)
12 Seat body
15 Tilting allowance hole
16 Support wall
18 Abutting wall
19 Elastic member
20 Insertion hole
21 Slide guide
22 Coming-off restriction member (coming-off restriction portion)
23 Guide surface
24 Spacer member
26 Cover member
26*b* Protruding portion
27 Support member
27*a* Outward flange (lower wall portion)
27*b* Cylindrical portion (standing wall portion)
27*c* Upper wall portion (standing wall portion)

The invention claimed is:

1. A chair comprising:

an installation base which is mounted on or fixed to an installation surface and includes a tilting allowance hole;

a leg column which stands upward from the installation base and is supported by the installation base in a tiltable manner;

a seat body which is supported on an upper part of the leg column to receive a seating load of an occupant;

an elastic member which is interposed between the leg column and the installation base and urges the leg column to take a vertical posture which is an initial tilted posture;

a support wall which supports the elastic member on the installation base and has an insertion hole; and a coming-off restriction portion which penetrates the support wall from below to restrict coming-off of the leg column from the installation base, wherein, in the support wall of the installation base, part of the coming-off restriction portion is inserted through the insertion hole, and a slide guide coming into slidable contact with a lower surface of a peripheral edge portion of the insertion hole of the coming-off restriction portion is provided, and the coming-off restriction portion has a spherical guide surface which upwardly protrudes and comes into slidable contact with the slide guide below the insertion hole.

2. The chair according to claim 1, wherein the elastic member is sandwiched and fixed in a compressed state between the leg column and the support wall of the installation base.

3. The chair according to claim 2, wherein an abutting portion of the slide guide coming into contact with the guide surface of the coming-off restriction portion is a protruding curved surface.

4. The chair according to claim 3, wherein the abutting portion of the slide guide coming into contact with the guide surface of the coming-off restriction portion is formed in an annular shape along a circumferential region of the insertion hole.

5. The chair according to claim 3, wherein the support wall and the slide guide of the installation base are formed of separate members.

6. The chair according to claim 3, wherein the leg column has an abutting wall which protrudes outward in a radial direction from a main body portion of the leg column and comes into contact with an upper surface of the elastic member.

7. The chair according to claim 3, wherein:

the coming-off restriction portion is formed of a component different from a member of a main body portion of the leg column; and in a state in which the elastic member is sandwiched between the member of the main body portion and the support wall of the installation base, the coming-off restriction portion is fastened and fixed to the member of the main body portion together with the support wall, and a spacer member which restricts displacement of the coming-off restriction portion with respect to the member of the main body portion in approaching and separating directions is provided.

8. The chair according to claim 1, wherein an abutting portion of the slide guide coming into contact with the guide surface of the coming-off restriction portion is a protruding curved surface.

9. The chair according to claim 8, wherein the abutting portion of the slide guide coming into contact with the guide surface of the coming-off restriction portion is formed in an annular shape along a circumferential region of the insertion hole.

10. The chair according to claim 8, wherein the support wall and the slide guide of the installation base are formed by separate members.

11. The chair according to claim 1, wherein the leg column has an abutting wall which protrudes outward in a radial direction from a main body portion of the leg column and comes into contact with an upper surface of the elastic member.

12. The chair according to claim 1, wherein:

the coming-off restriction portion is formed of a component different from a member of a main body portion of the leg column; and in a state in which the elastic member is sandwiched between the member of the main body portion and the support wall of the installation base, the coming-off restriction portion is fastened and fixed to the member of the main body portion together with the support wall, and a spacer member which restricts displacement of the coming-off restriction portion with respect to the member of the main body portion in approaching and separating directions is provided.

13. The chair according to claim 1, wherein the leg column has an abutting wall which presses an upper surface of the elastic member, the tilting allowance hole of the installation base is disposed above the abutting wall of the leg column, the leg column is tiltably inserted into the tilting allowance hole, a cover member which is tiltably and integrally engaged with the leg column and closes the tilting allowance hole from below is disposed above the abutting wall, and downward displacement of the cover member is restricted by the leg column in a state in which the cover member is not fixed to the leg column.

14. The chair according to claim 1, wherein the downward displacement of the cover member is restricted by the abutting wall in a state in which the cover member is not fixed to the abutting wall.

* * * * *